US005992287A

United States Patent [19]

Dube

[11] Patent Number: 5,992,287

[45] **Date of Patent: *Nov. 30, 1999**

[54] 2-PIECE CUTTER BLADE FOR PRODUCING HELICAL VEGETABLE STRIPS

[75] Inventor: Jocelyn A. Dube, Summerside, Canada

[73] Assignee: McCain Foods Limited, Florenceville, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/887,345

[22] Filed: Jun. 24, 1997

Related U.S. Application Data

[63] Continuation of application No. 08/448,776, May 24, 1995, abandoned.

[51] Int. Cl.[6] ..... B26D 3/11; B26D 3/26; B26D 11/00

[52] U.S. Cl. ..... 83/865; 83/356.3; 83/592; 83/932; 241/92; 241/282.2; 99/538

[58] Field of Search ..... 83/355, 356.3, 83/591, 592, 672, 862, 865, 932, 856, 857, 858; 99/537, 538; 241/92, 273.2, 278.1, 282.2

[56] References Cited

U.S. PATENT DOCUMENTS

| | | | |
|---|---|---|---|
| 237,844 | 2/1881 | Evinger | 83/592 X |
| 1,687,910 | 10/1928 | Valabregue | 30/351 |
| 2,511,464 | 6/1950 | Cover | 99/635 |
| 3,391,718 | 7/1968 | Cooke et al. | 83/591 |
| 3,783,727 | 1/1974 | Brignard et al. | 83/356.3 X |
| 3,815,458 | 6/1974 | Jirousek | 83/83 |
| 4,199,112 | 4/1980 | MCLean | 241/92 |
| 4,256,265 | 3/1981 | Madan | 241/92 |
| 4,364,525 | 12/1982 | McClean | 241/92 |
| 4,367,667 | 1/1983 | Shibata | 83/356.3 |
| 4,369,680 | 1/1983 | Williams | 83/13 |
| 4,393,737 | 7/1983 | Shibata | 83/356.3 |
| 4,644,838 | 2/1987 | Samson et al. | 83/865 |
| 4,704,959 | 11/1987 | Scallen | 99/538 |
| 4,979,418 | 12/1990 | Covert et al. | 83/865 |
| 5,042,342 | 8/1991 | Julian | 83/98 |
| 5,138,940 | 8/1992 | Geissler et al. | 99/538 |
| 5,167,178 | 12/1992 | Cimperman et al. | 83/865 |
| 5,201,259 | 4/1993 | Covert et al. | 83/865 |
| 5,211,098 | 5/1993 | Mendenhall | 83/865 |
| 5,224,409 | 7/1993 | Cimperman et al. | 83/862 |

FOREIGN PATENT DOCUMENTS

| | | | |
|---|---|---|---|
| 0 377 075 | 7/1990 | European Pat. Off. . | |
| 0 514 006 | 11/1992 | European Pat. Off. . | |
| 0 540 909 | 5/1993 | European Pat. Off. . | |
| 2 354 683 | 2/1978 | France | 83/356.3 |
| 457822 | 3/1928 | Germany . | |
| 1 000 577 | 6/1957 | Germany . | |
| 3869 | 8/1917 | Netherlands . | |
| 296966 | 5/1954 | Switzerland . | |

*Primary Examiner*—Rinaldi I. Rada
*Assistant Examiner*—Boyer Ashley
*Attorney, Agent, or Firm*—Emrich & Dithmar

[57] ABSTRACT

A cutter disk is removably mounted in equipment that cuts potatoes into helical strips. A knife blade extends radially outwardly from the axis of rotation of the disk and is axially displaced from the front surface of the disk. A plurality of slitter blades is integral and one piece with a slitter plate. The slitter blades extend from and are perpendicular to the front surface of the plate. The slitter blades respectively extend through spaced slots in the disk located at different distances from the axis of rotation. A backing plate removably secures the slitter plate to the disk so that the slitter plate can be readily removed for maintenance without removing the disk from the equipment. Two spaced-apart projections on the backing plate constrain the slitter plate therebetween to minimize lateral movement.

10 Claims, 1 Drawing Sheet

2-PIECE CUTTER BLADE FOR PRODUCING HELICAL VEGETABLE STRIPS

This is a continuation of application Ser. No. 448,776, filed May 24, 1995, now abandoned.

BACKGROUND OF THE INVENTION

This patent application relates generally to an apparatus for mass producing helical vegetable strips, and specifically to a rotating cutter used on such an apparatus. French fried potatoes and other vegetables of generally spiral or helical shape have become increasingly popular. Consumers like them because of their interesting appearance, and they are appealing to institutional food providers and restauranteurs because a given volume of french fries has more plate coverage when they are of helical shape.

Systems for cutting helical french fries are currently available in the marketplace. The cutters in many of the systems are disk-like in nature; that is, the cutter which slices the potatoes or other vegetables into helical strips is generally a substantially flat or helical circular plate having a knife blade or "slabber blade" extending from the axis of rotation to the periphery of the disk. Mounted directly on the front face of the disk is a plurality of slitter blades. The slitter blades are located at different radii from the axis of rotation and sometimes are spaced with a radial pitch to one another.

The previously described rotating cutters are used in conjunction with various feed systems to feed whole potatoes into the rotating cutter. One such feeding means is a hydraulic feed system. In such a system, potatoes are placed in a hydraulic medium which is pumped through a conduit. The outlet of the conduit is positioned to be in alignment with the rotating cutter. The potatoes are transported to the rotating cutter by the hydraulic medium.

The slitter blades extending from the surface of the cutter first contact the potato and score it. The locations of the slitter blades and their spacing from each other determine the width of each helical potato strip to be cut. The slabber blade then cuts each helical strip into a desired thickness. The length of the resulting helical strip is controlled by the length of the whole potato. Preferably, the slabber blade cuts a continuous helical strip the entire length of the potato.

A problem encountered with this type of cutting system involves the repair, maintenance or replacement of the slitter blades themselves. The slitter blades are relatively thin compared to the disk and have a tendency to dull, bend or break and must be sharpened, repaired or replaced frequently, often more than once a day. The slabber blade, on the other hand, is much thicker than the slitter blades and does not dull, bend or break as easily as the slitter blades. As a result, the disk which incorporates the slabber blade has to be replaced much less frequently than the slitter blades. Since the slitter blades are mounted or affixed directly to the surface of the cutter disk in the prior art, the entire cutter disk must ordinarily be removed from the feed system in order to resharpen, repair, clean or replace one or more of the slitter blades, thus making the system completely inoperable until maintenance has been completed and the cutter disk replaced in the system. This results in an increase in down-time and a decrease in productivity.

Applicant is aware of one 2-piece rotating cutter system in the marketplace. The system, as disclosed in U.S. Pat. No. 5,224,409, includes a disk, comprised of two separate halves which are affixed together in operation. One half of the disk contains both the slabber and slitter blades. The slabber and slitter blades are included in one set of blades with both vertical and horizontal sharpened edges. The vertical sharpened edges are the slitter blades, and the horizontal sharpened edges are the slabber blades. This system encounters the same problems noted above regarding increased down-time and decreased productivity with respect to maintenance, repair and replacement of the blades. Moreover, when only the slitter blades need to be replaced, the slabber blades must be replaced as well, and vice-versa. Furthermore, when replacing the blades, the half disk upon which the blades are mounted must also be replaced. Most of this surface material is not used to cut the potato and, thus, it does not wear out during the life of the cutter.

SUMMARY OF THE INVENTION

It is, therefore, an important object of the invention to improve productivity and reduce down-time because of repair, maintenance or replacement of slitter blades on cutter disks.

It is another object of the invention to reduce repair, maintenance and replacement costs of slitter blades on cutter disks.

It is another object of the invention to maintain the structural integrity of the cutter disks while incorporating a 2-piece design.

In summary, there is provided an invention comprising a cutter having a generally circular disk which has a radial slit therein defining a cutting edge which extends from the axis of rotation to the periphery of the disk, the leading edge being sharpened to create a slabber blade, and a plurality of slots radiating from the center of the disk towards the outer periphery, a plate or insert which is removably secured to the disk and upon which is incorporated a plurality of integral slitter blades which extend from and are substantially perpendicular to the plate. The slitter blades align with said slots on the face of the disk and extend therethrough when the removable plate is secured to the disk.

The invention consists of certain novel features and a combination of parts hereinafter fully described, illustrated in the accompanying drawings and particularly pointed out in the appended claims, it being understood that various changes in the details may be made without departing from the spirit or sacrificing any of the advantages of the present invention.

BRIEF DESCRIPTIONS OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
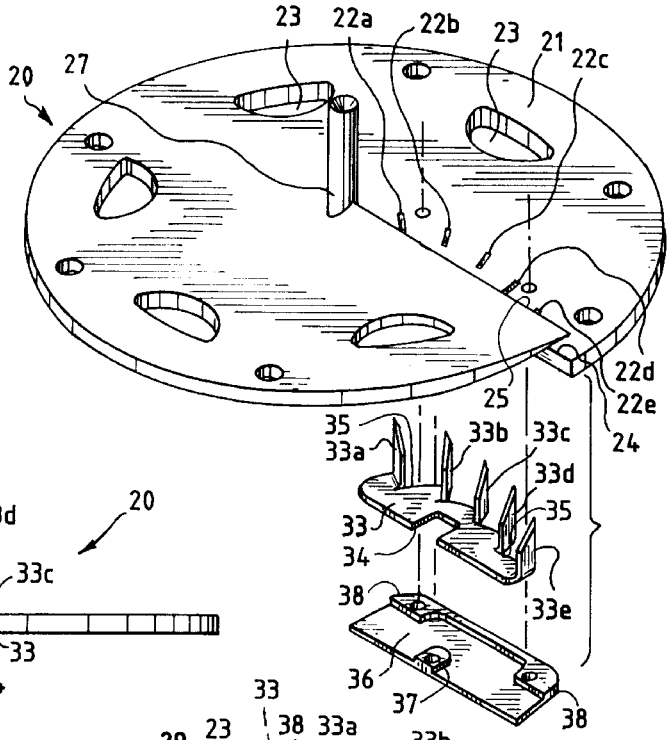
FIG. 1 is an exploded perspective view of a cutter assembly for producing helical potato strips incorporating the features of the present invention, showing the removable slitter blade insert and accompanying backing plate used to secure the slitter blade insert to the cutting disk.
Figure 2:
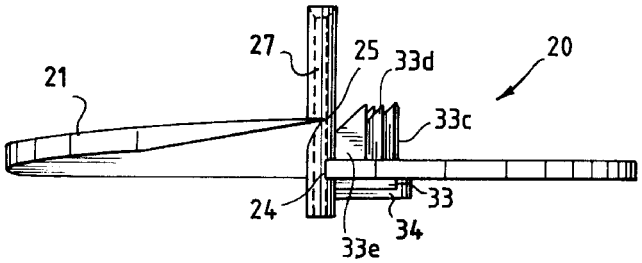
FIG. 2 is a side view of the cutter assembly of FIG. 1.
Figure 3:
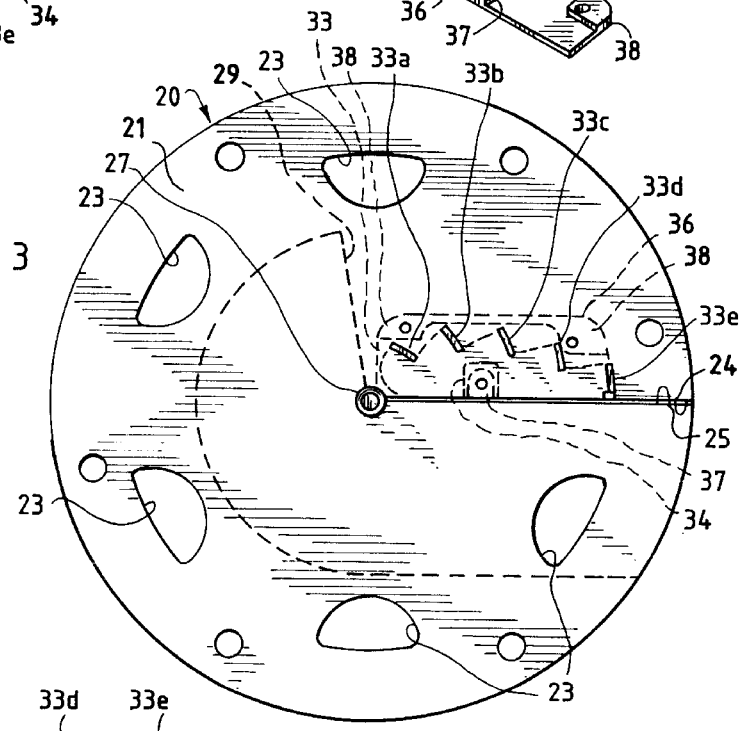
FIG. 3 is a top view of the cutter assembly of FIG. 1.

Turning now to FIGS. 1, 2, and 3, there is depicted a cutter assembly 20 for cutting potatoes into generally helically shaped strips, which cutter incorporates the features of the present invention. Cutter 20 comprises a circular disk 21 having several apertures 23 in its interior and a plurality of slots, 22*a*, 22*b*, 22*c*, 22*d*, and 22*e*, radiating from the center of the disk towards the outer periphery. Preferably, the slots are arranged in a shallow arc. Disk 21 is slit radially to produce a pair of edges 24 and 25 which are substantially parallel, spaced from each other and axially displaced. The leading edge 25 is sharpened to create a cutter blade ordinarily known as a slabber blade. In a preferred embodiment of the present invention, disk 21 has a substantially flat first part extending approximately 100° in an arc between edge 24 and phantom line 29, and a raised second part extending approximately 260° in an arc between phantom line 29 and slabber blade 25. In another embodiment, disk 21 may be formed into a right helicoid beginning at edge 24 and terminating at raised edge 25 and having a substantially uniform pitch therebetween. In either embodiment, the slabber blade 25 is integral with and formed from the disk 21 and axially displaced from the front surface of the disk 21. The slabber blade 25 is axially displaced from the front surface of the disk so that the cutter disk will cut helical strips of even thickness. The slabber blade 25 does not have to be integral with and formed from the disk 21, and can be a separate blade axially displaced from and attached to the front surface of the disk 21 by screws or other securing means which are readily known in the art. In all embodiments, a quill or center tube 27 projects axially from the center of disk 21. The quill may be solid or hollow.

Figure 4:
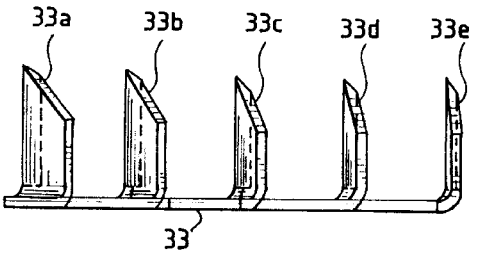
FIG. 4 is an enlarged side view of the removable slitter blade insert.

Turning now to FIG. 4, in a preferred embodiment, five slitter blades, 33*a*, 33*b*, 33*c*, 33*d*, and 33*e*, are one piece and formed from a removable slitter plate or insert 33 for mounting on the disk 21. In another embodiment, the slitter blades may be separate from and secured to the plate. The slitter blades, 33*a*, 33*b*, 33*c*, 33*d*, and 33*e*, are arranged on the removable insert 33 to correspond and align with the slots, 22*a*, 22*b*, 22*c*, 22*d*, and 22*e*, respectively, on disk 21. Slitter plate 33 includes a slot 34 on the side away from blades 33*a*–*e* and also two notches 35 on the other side, adjacent blades 33*a* and 33*e*, respectively. The removable plate 33 may be secured to the disk 21 by a variety of means, such as by screws and nuts extending through aligned holes in the disk 21 and plate 33. In a preferred form, a backing plate 36 is provided to aid in securing plate 33 to disk 21. The backing plate 36 includes three threaded screw holes which align with three threaded screw holes on the disk 21. Backing plate 36 includes projection 37 centrally on one side and two projections 38 respectively at the ends of the other side. When the parts are assembled, projection 37 is located in slot 34 and projections 38 fit into notches 35, respectively. The backing plate 36 is removably secured to the back surface of the disk 21 with three screws such that the plate 33 opposes the back surface of the disk 21 and the backing plate 36 and is trapped therebetween. Thus, the slitter plate 33 is captured between backing plate 36 and disk 21. Also, projection 37 being in slot 34 and projections 38 being in notches 35, lateral movement of slitter plate 33 is prevented. In this way, no holes have to be made in the insert.

Preferably, the slitter blades, disk, and removable backing plate are made of steel and are approximately 0.035 inches, 0.140 inches, and 0.060 inches in thickness, respectively.

In operation of the cutting assembly, the cutter rotates counterclockwise. Blade 33*a* is innermost, and, as the cutting disk rotates, leads blade 33*b*. In a similar manner, blade 33*c* is next and trails blade 33*b*. Blade 33*d* is next and trails blade 33*c*. Blade 33*e* is outermost and trails blade 33*d*. In one operative embodiment, the angles between edge 24 and the midpoints of blades 33*a*, 33*b*, 33*c*, 33*d*, and 33*e* are, respectively, about 44.0°, 30.6°, 19.7°, 10.4°, and 3.1°.

In operation, a potato is propelled into cutter 20 by a feed means (not shown). As the potato approaches cutter 20, it first contacts quill 27 which keeps the potato axially aligned with the axis of the quill. Because of the rounded shape of the end of the potato, the point of slitter blade 33*a* first makes contact with the front end of the potato during the first rotation of cutter 20, and blade 33*a* begins scoring the potato concentrically about the longitudinal axis of the potato. Then blade 33*b* starts scoring the potato. The slabber blade starts cutting even before the outer slitter blades score the potato. Finally, blades 33*c*, 33*d*, and 33*e* start to cut. As the potato continues to be fed into cutter 20, it contacts edge 25 which begins cutting the potato transversely to the longitudinal axis of the potato, thereby forming helical strips. The widths of the strips are determined by the spacing between adjacent slitter blades. It will be appreciated by those skilled in the art that the number of slitter blades may vary to include more or less than five as a particular application may require.

This construction increases the productivity of said cutter by decreasing maintenance down-time. When one or more slitter blades need to be resharpened, cleaned, repaired or replaced, the removable slitter blade insert can be quickly and easily removed for cleaning, resharpening, repair and immediate replacement with a substitute slitter blade insert. In this way, maintenance down-time is significantly decreased thereby substantially increasing productivity.

What has been described, therefore, is an improved cutter for cutting vegetables into helical strips incorporating a removable plate incorporating slitter blades. Productivity is significantly increased by decreasing maintenance down-time through the use of a removable slitter blade insert.

While a preferred embodiment of the present invention has been described, it is to be understood that the scope of the invention is defined by the following claims:

What is claimed is:

1. A rotating cutter for cutting helical vegetable strips comprising: a cutter disk having a front surface, a back surface, an axis of rotation, and a knife blade thereon extending radially outwardly from the axis of rotation and being axially displaced from said front surface; said disk having a plurality of slots spaced apart from one another and located at different distances from the axis of rotation; a slitter plate having a front surface and a back surface; a plurality of slitter blades integral and one piece with said slitter plate and extending from and being substantially perpendicular to said front surface thereof, said slitter blades extending through said slots in said disk, a backing plate, first and second spaced-apart projections on one surface of said backing plate, said first projection being located adjacent to one side of said surface of said backing plate, said second projection being located adjacent to an opposing side of said surface of said backing plate, said slitter plate being positioned between said projections to constrain said slitter plate and minimize lateral movement thereof and means for removably securing said backing plate to said disk.

2. The rotating cutter of claim 1, wherein said front surface of said disk is substantially flat.

3. The rotating cutter of claim 1, wherein said means for removably securing said backing plate to said disk include screw fasteners.

4. The cutter of claim 1, wherein said slots are arranged in a shallow arc.

5. The cutter of claim 1, wherein said slitter blades are one piece with said slitter plate.

6. The slitter of claim 1 wherein said projections are integral and one piece with said backing plate.

7. The slitter of claim 1 further comprising a third projection located adjacent to the same side of said surface as said first projection, said first projection and said third projection serving to further constrain said slitter plate and further minimize lateral movement thereof.

8. The rotating cutter of claim 1, wherein said disk is circular.

9. The rotating cutter of claim 8, wherein the periphery of said disk is substantially helical.

10. The rotating cutter of claim 9, wherein the periphery of said disk has a substantially uniform pitch.

* * * * *